United States Patent [19]

DeChristopher

[11] Patent Number: 4,965,106

[45] Date of Patent: Oct. 23, 1990

[54] FOLDED AND ASSEMBLED MOSAIC BLOCK

[76] Inventor: Eugene L. DeChristopher, 20 Ahlstrom Rd., Cotati, Calif. 94928

[21] Appl. No.: 396,973

[22] Filed: Aug. 22, 1989

[51] Int. Cl.[5] ..... B65D 5/00

[52] U.S. Cl. ..... 428/34.2; 428/542.8; 446/488

[58] Field of Search ..... 446/487, 488; 428/542.8, 34.2

[56] References Cited

U.S. PATENT DOCUMENTS

| | | | |
|---|---|---|---|
| 241,409 | 5/1881 | Osborn | 428/542.8 X |
| 619,757 | 2/1899 | Johnstone et al. | 446/488 X |
| 2,315,164 | 3/1943 | Schiller | 446/487 X |
| 3,827,170 | 8/1974 | Lau | 40/158.1 |

*Primary Examiner*—Henry F. Epstein
*Attorney, Agent, or Firm*—Melvin R. Stidham

[57] ABSTRACT

A plurality of mosaic blocks having square bases and right triangular elevations rising from the bases may be nested together to form different patterns depending on the direction in which each triangular elevation is faced. Each mosaic block is erected from a blank, which is die-cut and scored from a relatively stiff sheet, such as cardboard, plastic or the like. The triangular top panel is folded over from the top edge of a tall side panel and then a diagonal panel is foled down and interlocked with a horizontal, square intermediate panel by inserting a tap into a slot formed along a diagonal of the square intermediate panel, which closes the top of the square base.

7 Claims, 3 Drawing Sheets

FOLDED AND ASSEMBLED MOSAIC BLOCK

BACKGROUND OF THE INVENTION

This inventor previously developed and is presently marketing mosaic kits, including a large number of small, square based mosaic blocks to be assembled within a frame to form a sculptured wall hanging. Such blocks are of molded, one piece plastic construction, and extending upward from the square base of each block is a right triangular protrusion with the two right angle sides formed as upward continuations of adjacent sides of the base and a third, hypotenuse side extending along the diagonal of the base. Hence, each square base may be rotated to be nested between other blocks with the triangular elevated portions facing in the same direction, or in different directions, to form a pattern of triangles, as created by the operator. These mosaic blocks, which are sold under the trademark "TRI-BLOCKS" may be of the same or different single colors or of multiple colors to form interesting designs or even a picture.

The inventor now wishes to extend this basic concept to supply kits for the formation of large wallcovering sculptures using larger mosaic blocks. However, if large blocks are pre-formed, as by molding, and offered as a kit, a package containing the number of blocks needed to cover a substantial portion of a wall would require a package that is extremely large and unwiedly.

OBJECTS OF THE INVENTION

It is an object of this invention to provide a lightweight mosaic block for a wall sculpture that can be packaged in large quantities very compactly.

It is a further object of this invention to provide a mosaic block of cardboard or the like formed from a pre-cut and scored sheet.

It is a further object of this invention to provide a mosaic block which can be folded from a cut and scored sheet.

It is a further object of this invention to provide a plurality of mosaic blocks that can be produced in sheet form to facilitate stacking and packaging.

Other objects and advantages of this invention will become apparent from the description to follow, particularly when read in conjunction with the accompanying drawings.

SUMMARY OF THE INVENTION

In carrying out this invention, I provide a plurality of mosaic blocks, which can be packaged and marketed in sheet form. The blocks are assembled on the job site by folding and interlocking panels which are cut and scored from sheet material, such as cardboard, plastic or the like. The blank includes two full height side panels and two partial height side panels, which are folded along score lines to form a square base. A square intermediate panel is connected by a score line to one of the partial height side panels so that it may be folded over to close the square base. Right triangular top panels are connected by score lines to the tops of the full height side panels so that they may be folded over and overlapped to form an elevated right triangular top panel, with a diagonal side face. The diagonal side face has a tab on the lower edge thereof, which is inserted into a slot formed along a diagonal of the square intermediate base panel.

DESCRIPTION OF A PREFERRED EMBODIMENT

Figure 1:
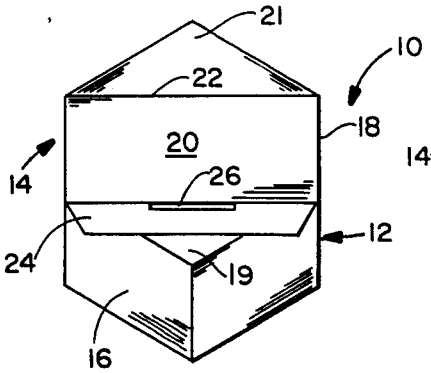
FIG. 1 is view in perspective showing the mosaic block of this invention just prior to final assembly.
Figure 2:
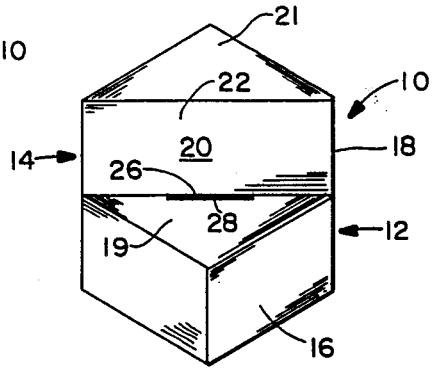
FIG. 2 is a view in perspective showing a mosaic block of this invention fully assembled.
Figure 3:
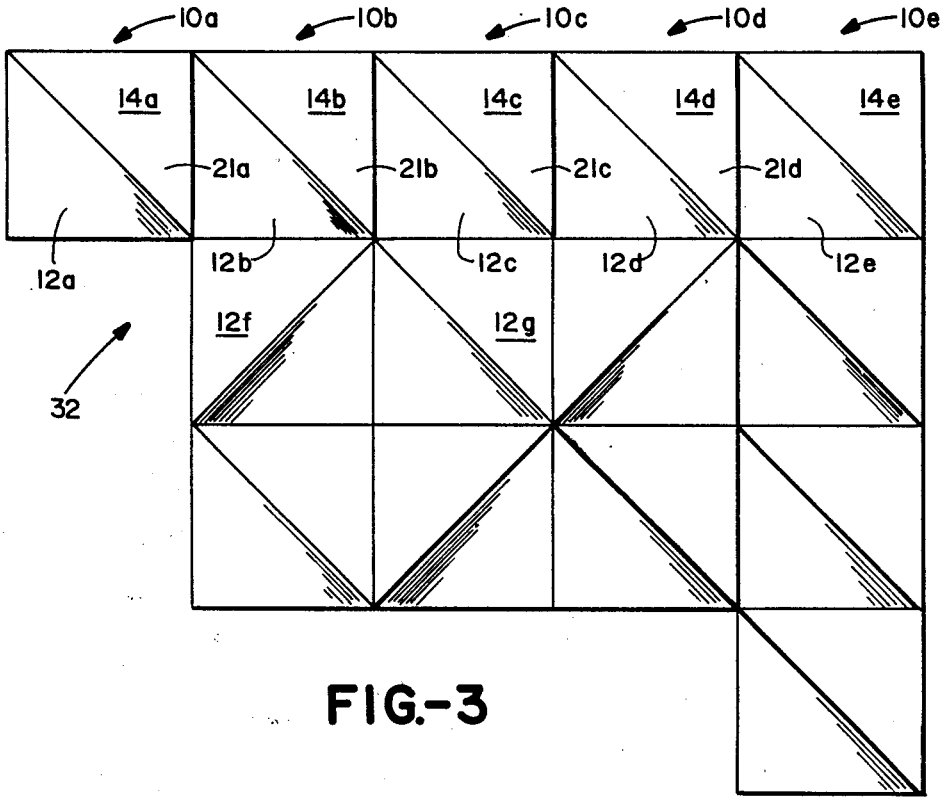
FIG. 3 is plan view of a wall sculpture partially assembled from mosaic blocks of this invention.

Referring now to FIGS. 1 to 3 with greater particularity, the mosaic block 10 of this invention includes a square base 12 and an elevated, right triangular crown portion 14. The base portion 12 includes two partial height side panels 16 and two full height panels 18, which form also the right angle sides of the triangular elevation. A square intermediate panel 19, which is hinged by a score line to one of the short side panels 16 is folded over to complete the base 12. The right triangular elevation 14 includes a diagonal or hypotenuse side panel 20 which is separated by a score line forming the hypotenuse of the right triangular top panel 21. The structure of FIG. 2 is completed by folding a flap 24 under the hypotentuse side panel 20 and inserting a small tab 26, which also depends from the diagonal side panel 20, into a slot 28 formed along a diagonal of the square intermediate panel 19.

As shown in FIG. 3, a wall sculpture 30 may be formed by nesting together the square bases **12*a*, 12*b*, 12*c* . . . of a plurality of mosaic blocks 10*a*, 10*b*, 10*c* . . . with the triangular elevations 14*a*, 14*b*, 14*c*** . . . forming a selected pattern. That is, the triangular elevations may be arranged to face in the same direction, as shown in the top row; they may be arranged with the full height sides back to back; or they may be arranged in other patterns depending on the design created by the artist.

Figure 4:
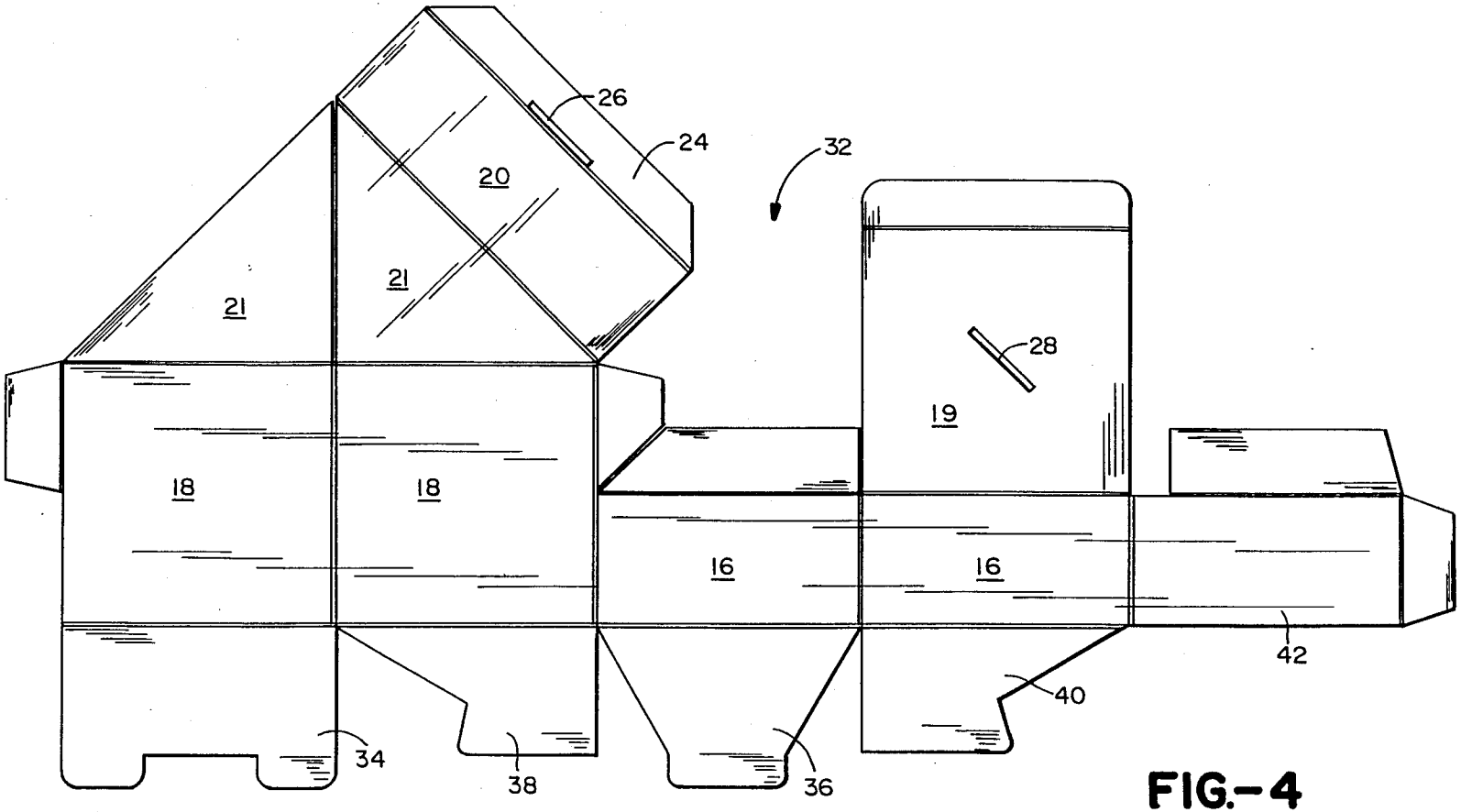
FIG. 4 is a sheet material blank pre-cut and scored for assembly into a mosaic block.

Referring now to FIG. 4, the mosaic block 10 is formed from a blank 32, which is pre-cut and scored from a relatively stiff sheet of cardboard, plastic or the like. The die-cut blank 32 includes the tall side panels 18, the short side panels 16, triangular top panels 21, a rectangular panel 20 to form the diagonal face and the square intermediate panel 19 with the diagonal slot 28. In addition, one pair of interlocking bottom flaps 34 and 36, and a second pair of engaging flaps 38 and 40 are hinged by score lines to alternate ones of the side panels 16 and 18. An extension panel 42 is hinged to the short panel 16 to be inserted inside the first tall side panel 18.

Figure 5:
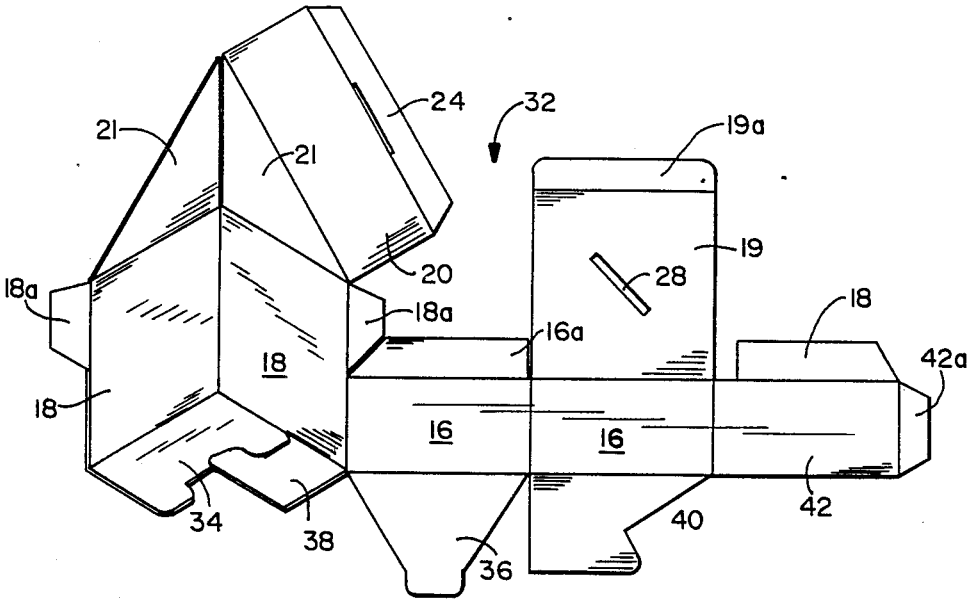
FIGS. 5, 6 and 7 show the blank in various progressive stages of assembly into a mosaic block.
Figure 6:
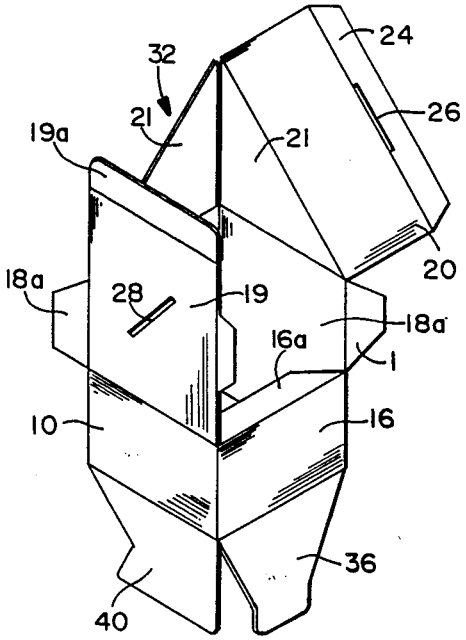
Figure 7:
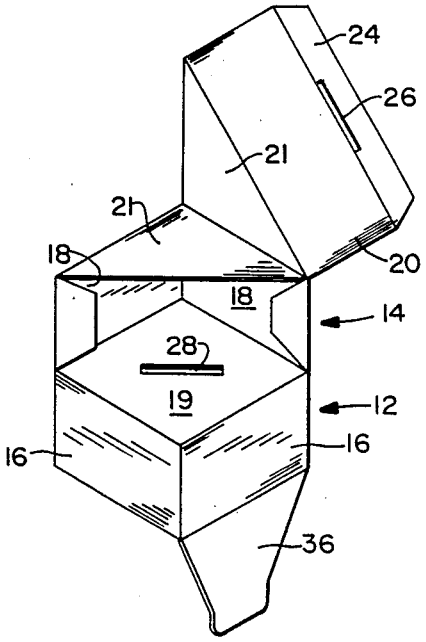

Referring now to FIGS. 5 to 7, the block is assembled by folding the tall side panels 18 to form one corner of the block and folding the short side panels inward to form the opposite corner while inserting the extension 42 inside the first tall side panel 18. The intermediate panel 19 is folded over to close the top of the base and the bottom flaps 34, 36, 38 and 40 folded and interlocked to form the bottom closure. With the intermediate panel 19 in place, the top triangular panels 21 are folded and overlapped and the diagonal panel 20 folded down with the tab 26 or flap 24 tucked under. The diagonal panel is locked in place by inserting the tab 26 into the slot 28 to complete the block, as shown in FIGS. 1 and 2. If desired, the mosaic block 10 may be rigidified by applying glue to the flaps 16*a* and 18*a*, 19*a* and 42*a* to attach them firmly to the inner surface of an adjacent panel. For example, the tabs 18*a* may be glued to the inner surface of the diagonal panel 20, the tab 24 may be glued to the covered top surface of the intermediate panel 19, the flap 19*a* may be glued to the inner surface of one tall side panel 18 and the flap 42*a* may be glued to the inner surface of the other tall side panel 18.

As the blocks 10 are assembled, they may be turned as previously described and nested with each triangular elevation facing as desired.

While this invention has been described in conjunction with a preferred embodiment thereof, it is obvious that modifications and changes therein may be made by those skilled in the art to which it pertains without departing from the spirit and scope of this invention, as defined by the claims appended hereto.

What is claimed as invention is:

1. A lightweight, hollow mosaic block for a wall sculpture comprising:

a square base including first, second, third and fourth rectangular side panels connected in series by score lines and a reinforcing panel separated from said fourth panel by a score line and extending along the inner face of said first panel, a square bottom closure and a square horizontal intermediate panel; and triangular raised member including one upright diagonal side face disposed diagonally across said square intermediate panel, two perpendicular upright side faces formed as integral planar continuations of said first and second side panels, and overlapped upper and lower horizontal, right triangular top panels;

there being a hinged score lines connecting said diagonal side vertical face and the upper one of said triangular top panels.

2. The hollow mosaic block defined by claim 1 including:

means forming a slot in said square intermediate panel in the plane of said diagonal side face; and a tab depending from said one upright diagonal side face received in said slot; and a flap connected to the lower edge of said diagonal side face folded back under said raised member.

3. The hollow mosaic block defined by claim 1 wherein:

said bottom closure includes two interlocking flaps connected by score lines to opposite ones of said side panels.

4. The hollow mosaic block defined by claim 1 wherein:

said square intermediate panel is hingedly connected by a score line to a side panel next to one of said first and second side panels.

5. A blank for a lightweight mosaic block for a wall sculpture comprising:

a sheet member cut and scored to provide successively, two full height side panels, two partial height side panels, and a partial height side panel reinforcement, all said side panels and said side panel reinforcement being of equal width and separated by score lines;

a square intermediate panel connected by a score line to the top of one of said partial height side panels;

means forming a slot in said square intermediate panel along the diagonal thereof;

bottom closure flaps connected by score lines to the bottoms of said side panels;

right triangular top panels connected by score lines, to the top of said full height side panels;

a diagonal side face connected by a score line along one side thereof to the hypotenuse of one of said triangular top panels;

a tab on the opposite side of said diagonal side face to be received in said slot.

6. The blank defined by claim 5 including:

a flap hingedly connected to said opposite side of said diagonal side face.

7. The blank defined by claim 5 wherein:

said bottom closure flaps are formed to interlock.

* * * * *